United States Patent [19]

Tsuchida et al.

[11] Patent Number: 4,707,195

[45] Date of Patent: Nov. 17, 1987

[54] ALUMINUM ALLOY SHEET FOR CONTAINERS EXCELLENT IN CORROSION RESISTANCE AND METHOD OF PRODUCING SAME

[75] Inventors: Shin Tsuchida, Nagoya; Hideo Ito, Gifu, both of Japan

[73] Assignee: Sumitomo Light Metal Industries, Ltd., Tokyo, Japan

[21] Appl. No.: 659,981

[22] Filed: Oct. 12, 1984

[30] Foreign Application Priority Data

Mar. 5, 1984 [JP] Japan ..... 59-040494

[51] Int. Cl.[4] ..... C22F 1/04

[52] U.S. Cl. ..... 148/11.5 A; 148/439; 420/534; 428/653

[58] Field of Search ..... 148/11.5 A, 2, 439; 420/534; 428/653

[56] References Cited

U.S. PATENT DOCUMENTS 3,787,248 1/1974 Setzer et al. ..... 148/11.5 A 4,282,044 8/1981 Robertson et al. ..... 148/11.5 A

*Primary Examiner*—R. Dean

*Attorney, Agent, or Firm*—Flynn, Thiel, Boutell & Tanis

[57] ABSTRACT

A high corrosion resistant aluminum alloy sheet useful in the manufacture of containers for saline food and beverage, especially suited for easy opening can end manufacturing, which is made of an aluminum alloy consisting essentially of, by weight percentages Mg: from 0.50 to 2.0%

Si: from 0.10 to 0.70%

Mn: from 0.30 to 1.5%

Cu: from 0.10 to 1.0% and the balance being essentially aluminum, the spontaneous electrode potential of the sheet being in the range of from −700 to −630 mV in a 0.1% sodium chloride solution at 25° C., against an AgCl reference electrode. The aluminum alloy sheet is fabricated through a series of steps of hot rolling a cast ingot with the foregoing composition; intermediate cold rolling to an intermediate thickness which is at least one and a half times a final thickness; heating to a temperature of 500° C. or higher; then rapidly cooling from the temperature; and then final cold rolling. The spontaneous electrode potential of the invention alloy sheet is the same level as that of the mild steel or tin-free steel and, thus, can be used in combination with these steel can body materials without causing any detrimental galvanic corrosion.

3 Claims, No Drawings

ALUMINUM ALLOY SHEET FOR CONTAINERS EXCELLENT IN CORROSION RESISTANCE AND METHOD OF PRODUCING SAME

BACKGROUND OF THE INVENTION

The present invention relates to corrosion resistant aluminum alloy sheets for containers and method of producing same. More particularly, the present invention is directed to aluminum alloy sheets useful as metallic can stock, especially as can end stock, for various saline beverages, such as health drinks, tomato juice, etc., food or the like.

Conventionally, mild steel materials, such as tinfree steel sheets or tinplate sheets, have been extensively employed in end parts of cans for the aforesaid saline beverages and other foods. However, it is very difficult to open can ends made of the conventional mild steel sheets because of its high strength and thus there is a risk that the user's hands will be wounded when opening the can.

On the other hand, when aluminum alloy sheets having a easy open property are employed in manufacturing of can ends, the sheets are fabricated from Al-Mg type aluminum alloys, for example, JIS A 5052 and 5082 (throughout this specification, aluminum alloy numbers are represented under Japanese Industrial Standard designations unless otherwise indicated) and a resin coating with a sufficient thickness is applied onto the sheets with a view to protecting the aluminum alloy sheet ends from being corroded by the saline contents. However, it is very difficult for such coating treatment to provide a complete protection coating in industrial production and, thus, it has been for a long time highly desirable to develop corrosion resistant aluminum alloy sheets not suffering corrosion even if the applied protection coatings are incomplete.

As types of corrosions encountered with the conventional cans, there are known a microscopic self-corrosion related to the metallurgical structure of the materials themselves and a macroscopic galvanic corrosion caused from a contact potential between a can end material and can body material. The contact potential arises when different materials are employed in can ends and bodies. Particularly, when a body is formed of mild steel and an end is made of aluminum alloy, such galvanic corrosion phenomenon considerably occurs. Therefore, the galvanic corrosion can not be completely prevented unless the same material is employed in both parts of can bodies and can ends. When tin-free steel, tin plate or the similar mild steels are employed in bodies and ends, the galvanic corrosion is slight, but these mild steels present difficulty as regards to easy opening property of the ends. On the other hand, in the case of using aluminum alloys in can bodies and can ends, for example, JIS A 3004 for bodies and the other different aluminum alloys, such as JIS A 5052 or A 5082, for ends, galvanic corrosion is not negligible.

Further, Al-Mg type aluminum alloys, for example, A 5052, A 5082, A 5182, or the like are employed as can end materials in can manufacturing for low salt content beverages, such as carbonated drinks and beer. In this case, galvanic corrosion is caused by the contact potential between the can end and the mild steel can body with increase in salt content and, thus, the aluminum alloy sheets can not employed as can end stock unless coating having sufficient protection against galvanic corrosion are applied onto them.

SUMMARY OF THE INVENTION

It is therefore an object of the present invention to overcome difficulties or problems encountered in conventional cans for saline beverages and other foods, and particularly to provide high corrosion resistant aluminum alloy sheets for containers which exhibit a considerable effect in reducing galvanic corrosion and other corrosions caused by saline contents when employed as can materials for saline beverages, food and other goods, especially as can end materials in combination with mild steel can body materials.

Another object of the present invention is to provide a method of producing the foregoing aluminum alloy sheets with an excellent corrosion resistance in a high yield.

In the first feature, the present invention resides in an aluminum alloy sheet with an excellent corrosion-resistance which consists essentially of, in weight percentages:

Mg: from 0.50 to 2.0%
Si: from 0.10 to 0.70%
Mn: from 0.30 to 1.5%
Cu: from 0.10 to 1.0% and the balance being essentially aluminum, the spontaneous electrode potential of the sheet being in the range of from −700 to −630 mV in a 0.1% sodium chloride solution at 25° C., against an AgCl reference electrode.

The further aspect of the present invention is in a method of producing the aluminum alloy sheet set forth above, the method comprising the steps of:

hot rolling a cast ingot in a conventional manner, the cast ingot consisting essentially of, in weight percentages:

Mg: from 0.50 to 2.0%
Si: from 0.10 to 0.70%
Mn: from 0.30 to 1.5%
Cu: from 0.10 to 1.0% and the balance being essentially aluminum ;

cold rolling to a sheet with a thickness of at least one and a half times a final thicknes;

heating to a temperature of 500° C. or higher and then rapidly cooling from the temperature; and final cold rolling.

DETAILED DESCRIPTION OF THE PREFERRED EMBODIMENTS

The first feature of the present invention resides in an aluminum alloy sheet with an excellent corrosion-resistance, the sheet consisting essentially of (by weight percentages):

Mg: from 0.50 to 2.0%
Si: from 0.10 to 0.70%
Mn: from 0.30 to 1.5%
Cu: from 0.10 to 1.0% and the balance being aluminum except for incidental impurities which may be expected from the production of ingot.

The alloying elements enumerated above are selected with the objects of (1) preventing galvanic corrosion caused in combination with mild steel sheets and (2) ensuring both of strength and formability at sufficient levels as can end materials.

More specifically, Mg and Si are added to ensure strength at a desired level. When a Mg content is less than 0.50%, sufficient strength can not be obtained in a finished alloy. On the other hand, an addition exceeding 2.0% will significantly lowers galvanic corrosion resistance.

Si forms a fine-grained $Mg_2Si$ compound in combination with Mg and thereby improves strength. However, an addition of less than 0.1% does not afford a sufficient strength due to an insufficient formation of $Mg_2Si$, while addition of more than 0.70% excessively increases strength thereby impairing formability.

Mn has a strengthening effect without lowering galvanic corosion resistance and further enhances the strengthening effect imparted by Mg and Si. Amounts less than 0.30% do not afford a sufficient effect, while an addition exceeding 1.5% forms unfavorable coarse compounds, resulting in an unfavolable lowering of formability. It is well known that the formation of the coarse compounds of Mn can be suppresed by rapidly cooling in casting process and, in the case of employing such a special casting, Mn can be added in an amount exceeding 1.5%, but up to 2.5%, without causing any difficulties and the excessive formation of solid solution of Mn arised from rapid solidification in the case can be satisfy the requirements for the properties contemplated in the aluminum alloy sheets of the present invention. However, the excess addition beyond 1.5% has no further effect and, thus, an upper limit of 1.5% was taken for Mn content.

The principal reason for Cu addition is to bring the spontaneous electrode potential of the invention aluminum alloy sheet to the same level as that of the mild steel and whereby galvanic corrosion caused by the contact potential between the invention aluminum alloy and the mild steel may be effectively prevented. The prevention effect can not be expected in an amount of less than 0.10%, while an amount exceeding 1.0% increases the difference in spontaneous electrode potential against the mild steel in the reverse direction and the mild steel is liable to dissolve due to galvanic corrosion on the mild steel side. Thus, the excessive addition of Cu must be avoided. Further, aluminum alloy sheets containing a large amount of Cu exceeding 1.0% exhibit a reduced resistance to self corrosion resistance in a sodium chloride solution which makes them unsuitable for use as container materials for salt-containing food. Still further, Cu has also an effect in improving strength and formability.

Now, galvanic corrosion of aluminum alloy sheets caused by the spontaneous electrode potential difference from that of mild steel sheet will be explained hereinafter.

When two different metallic materials which differ from one another in spontaneous potential are contacted, a corrosive current will be flow depending the contact potential difference and the circuit resistances of the two materials. Galvanic corrosioon is the dissolution of an anode caused by the corrosive current and the dissolution amount $\Delta W$ is calculated in accordance to Faraday's law expressed below.

$$\Delta W(g/cm^2) = 9.3 \times 10^{-5} \times [\text{corrosive current}(A/cm^2)] \times [\text{time(sec.)}]$$

When the dissolution amounts exceed a certain level, metallic sheets are pierced and no longer serve as containers.

According to the inventors' experimental analysis, it has been found that with respect to easy open type aluminum can ends, a corrosive current at room temperature should be suppressed within the range of not more than 3 $\mu A/cm^2$, in order to avoid the thinnest portion (not more than 100 $\mu m$ thick) of the can ends from being pierced for a period of at least one year.

More specifically, in order to suppress galvanic corrosion occurring in an aluminum alloy can end material employed together with a mild steel can body material to an acceptable level for practical uses, it is requested that corrosive current between the foregoing two different materials which are joined to each other in an area ratio of 1:1 be in the range of $\pm 3$ $\mu A/cm^2$ and, accordingly, the spontaneous electrode potential difference between the two sheets be controlled within the range of $-30$ mV to $+30$ mV .

The spontaneous electrode potential of the aluminum alloy sheet of the present invention is in the range of $-700$ to $-630$ mV in a 0.1% sodium chloride solution at 25° C. and the potential range satisfies the requirements set forth above.

For the production of the aluminum alloy sheets according to the present invention, cast ingot with the foregoing composition is prepared and homogenized in accordance to the conventional procedures. Thereafter, the homogenized alloy is hot-rolled and cold-rolled. Particularly, after the hot-rolling, the alloy sheet is cold rolled to an intermediate thickness which is at least one and a half times a thickness of a finally cold-rolled sheet, the thus intermediate cold-rolled sheet is heated to a temperature of 500° C. or higher, and then rapidly cooled from the temperature, for example, by forced air-cooling. Following the heat treatment, final cold rolling is carried out to finish the desired aluminum alloy sheet product. By virture of the foregoing production steps, there can be obtained final products having highly improved properties, particulally in strengh and formability, without causing their spontaneous electrode potentials to depart from the level set forth above.

The foregoing intermediate thickness to be subjected to the heat treatments closely relates to the strength of the finished sheet products. When the intermediate thickness is below one and a half times the thickness of the final sheet products, it is difficult to achieve a sufficient strength for the use as container material. Particularly, where a higher strength is desired for use as can end materials, the intermeadiate thickness is preferable to be at least 2.5 times the thickness of the final cold-rolled sheets.

The present invention will now be described in detail hereinafter with reference to the examples.

EXAMPLE 1

Eight kinds of aluminum alloys with the compositions given in Table 1 were molten, cast into ingots and then homogenized. Thereafter, the ingots were hot rolled and cold rolled to a sheet form with a thickness of 0.8 mm. With respect to the alloy sheets thus fabricated, the spontaneous electrode potential was measured in a 0.1% sodium chloride solution at 25° C., using an AgCl electrode as a reference electrode, and indicated in the right column of Table 1. For reference, the spontaneous electrode potentials of a mild steel sheet and a tin free steel were also given. The spontaneous electrode potentials were continuously measured over a period of 60 minutes and their variation ranges in spontaneous electrode potential for time are shown.

TABLE 1

| No. | Alloy Composition (by weight %) Si | Cu | Mn | Mg | Spontaneous Electrode Potential (mV) |
|---|---|---|---|---|---|
| 1 | 0.63 | 0.15 | 0.67 | 1.32 | −670 to −690 |
| 2 | 0.55 | 0.30 | 0.72 | 1.13 | −660 to −690 |
| 3 | 0.25 | 0.52 | 0.82 | 1.27 | −650 to −680 |
| 4 | 0.18 | 0.83 | 0.59 | 1.29 | −640 to −670 |
| 5 | 0.20 | 0.31 | 1.21 | 0.94 | −660 to −680 |
| 6 | 0.75 | 1.68 | 0.02 | 0.38 | −610 to −640 |
| 7 | 0.07 | 0.01 | 0.03 | 2.67 | −680 to −730 |
| 8 | 0.09 | 0.02 | 0.14 | 4.68 | −700 to −750 |
| 9 | Mild Steel Sheet | | | | −670 to −690 |
| 10 | Tin Free Steel Sheet | | | | −660 to −680 |

Nos. 1 to 5: Alloy Sheets according to the Present Invention
Nos. 6 to 8: Comparative Alloy Sheets
Nos. 9 to 10: Reference Sheets As is clear from Table 1, it was proved that the alloy sheets Nos. 1 to 5 according to the present invention had almost the same spontaneous electrode potential levels as compared to those of the reference sheets made of the mild steel and the tin-free steel. The spontaneous electrode potential of the comparative sheet No. 6 was too noble due to an excessive Cu content and exhibited a large potential difference with respect to the steel sheet. The comparative sheets Nos. 7 and 8 were made of aluminum alloys corresponding to A 5052 alloy and A 5082 alloy, respectively which have been both heretofore extensively used as beverage can end materials. The potential difference between such conventional alloy materials and steel sheets are not less than 50 mV and detrimentally large from the viewpoint of the prevention of the aforementioned galvanic corrosion problem.

EXAMPLE 2

Ingots of alloys Nos. 1 to 6 given in Table 1 were homogenized, hot rolled and then intermediate cold rolled to provide 0.8 mm thick sheets. Following intermediate cold rolling, the alloy sheets were heated to 520° C. and compulsorily air-cooled. Subsequently, the sheets were finally cold-rolled to a thickness of 0.3 mm.

The thus formed sheets were subjected to coating and baking treatments which are usually conducted in can end manufacturing. Baking was carried out by repeating twice heating at 205° C. for 10 minutes. The thus obtained sheets were each examined on mechanical properties and the results are listed in Table 2.

Further, the aluminum alloy sheets were jointed to the mild steel sheet in an area ratio of 1:1 and immersed in a 0.1% sodium chloride solution at 25° C. Corrosive Current in the sodium chloride solution was measured and given in Table 2.

TABLE 2

| No. | Yield Strength kg/mm$^2$ | Tensile Strength kg/mm$^2$ | Elongation % | Earing Ratio % | Erichsen Value mm | Corrosive Current* μA/cm$^2$ |
|---|---|---|---|---|---|---|
| 1 | 31.5 | 34.0 | 10 | 1.0 | 5.1 | <±1~±2 |
| 2 | 31.7 | 35.5 | 9 | 1.0 | 5.3 | <±1 |
| 3 | 32.0 | 36.2 | 10 | 1.0 | 5.2 | <±1 |
| 4 | 33.3 | 37.7 | 11 | 1.0 | 5.4 | <±1 |
| 5 | 31.0 | 33.4 | 9 | 2.0 | 5.0 | <±1 |
| 6 | 24.5 | 27.2 | 7 | 3.5 | 4.7 | −1~−2 |
| 7 | 25.0 | 28.9 | 6 | 4.0 | 5.0 | 2~7 |
| 8 | 31.0 | 36.7 | 9 | 3.5 | 4.8 | 5~8 |

*Measured in a 0.1% Sodium Chloride Solution
Nos. 1 to 5: Alloy Sheets according to the present Invention
Nos. 6 to 8: Comparative Alloy Sheets It can be seen in Table 2 that the aluminum alloy sheets Nos. 1 to 5 in accordance to the present invention have a high strength and an excellent Erichsen value which are both equivalent or superior to the conventional can end materials made of the comparative alloys No. 7 and No. 8 and exhibits a lower earing ratio (anisotoropy for deep drawing) than those of the comparative sheets.

Further, in the case of the comparative sheets Nos. 7 and 8, a greater corrosive current exceeding 3 μA/cm$^2$ flows, while in the invention aluminum alloy sheets of Nos. 1 to 5, a very little corrosive current of ±1 to ±2 μA/cm$^2$ flows and, thus, it is obvious that galvanic corrosion is prevented.

Further, the spontaneous electrode potentials of the aforementioned aluminum alloy sheets were measured at 25° C. in a 0.5% sodium chloride solution instead of the above 0.1% sodium chloride solution against an AgCl reference eletrode and, further, in the same sodium chloride solution, the corrosive current was also measured for combination of each of the alloy sheets and the mild steel sheet joined in an area ratio of 1:1. After the measurement at 25° C., the 0.5% sodium chloride solution was heated to 120° C. and at the temperature, corrosive surrent was measured. The results are shown in Table 3.

TABLE 3

| No. | Spontaneous Electrode Potential*1mV | Corrosive Current*1 μA/cm$^2$ | Corrosive Current*2 μA/cm$^2$ | Evaluation*3 |
|---|---|---|---|---|
| 1 | −700 to −750 | 2 to 4 | 150 to 200 | Δ |
| 2 | −690 to −730 | 2 to 4 | 100 to 200 | Δ |
| 3 | −650 to −700 | > ± 1 | 100 to 200 | o |
| 4 | −620 to −660 | > ± 1 | 50 to 100 | o |
| 5 | −700 to −730 | 2 to 4 | 100 to 200 | Δ |
| 6 | −600 to −620 | > ± 1 | 10 to 40 | (o) |
| 7 | −670 to −720 | 2 to 5 | 600 to 1300 | X |
| 8 | −770 to −800 | 5 to 7 | 300 to 800 | X |

*1Measured in a 0.5% Sodium Chloride Solution at 25° C.
*2Measured in a 0.5% Sodium Chloride Solution at 120° C.
*3 : very good, Δ: good(practicable), X: bad(impracticable)
( ): very good(poor in self corrosion)
Nos. 1-5: Alloy Sheets according to the Present Invention
Nos. 6-8: Comparative Alloy Sheets In the case of a high salt content, the alloy sheets Nos. 3 and 4 of the present invention were found to have the optimum composition. The other invention alloy sheets Nos. 1, 2 and 5 exhibited a slightly increased corrosive current at 25° C.

On the other hand, when the sodium chloride solution was heated to 120° C., the corrosive current in the invention alloy sheet increased to the level of 50 to 200 μA/cm$^2$, but the increase was far less than that of conventional materials Nos. 7 and 8 and therefore it is obvious that even if the alloy sheets of the present invention are subjected to a sterilizing thermal treatment for food cans, they will maintain sufficient resistance to galvanic corrosion. Further, the mild steel sheet and the tin-free steel had the spontaneous electrode potentials in the ranges of −620 to −640 mV and −600 to −620 mV, respectively, in the 0.5% sodium chloride solution at 25° C. and, further, at the elevated temperature of 120° C., the potentials were more noble.

As previously described, galvanic corrosion due to the contact potential difference between the invention alloy sheets and the mild steel sheets is very slight and thus the aluminum alloy sheets of this invention are useful as can end materials in combination with the mild steel can bodies for saline food. Further, since the aluminum alloy sheets according to the invention have also a significantly increased resistance to other corrosions, they will can be used not only as can end materials but also as can body materials for the manufacturing of various aluminum cans.

The advantages derived from the present invention are summarized in the following.

(1) In all-steel cans, which are entirely made of steel, for saline beverages and the other foods, their can end materials can be replaced by the invention aluminum alloy materials suitable for use in manufacturing easy opening can end.

(2) Also, in all-aluminum can manufacturing, the aluminum alloy sheets of the present invention exhibits significantly better properties as can end materials.

(3) The alloy sheet of the present invention is useful not only as can end materials but also as can body materials.

(4) The invention alloy sheets make possible the production of unialloy cans in which can body stock and can end stock are both made of the same type aluminum alloy (Al-Mg-Mn-Cu-Si), whereby facilitates recycling process of empty cans after used.

What is claimed is:

1. An aluminum alloy sheet for containers excellent in resistance corrosion, said aluminum alloy sheet consisting essentially of, in weight percentages:

Mg: from 0.50 to 2.0%
Si: from 0.10 to 0.70%
Mn: from 0.30 to 1.5%
Cu: from 0.52 to 1.0% and the balance being essentially aluminum, the spontaneous electrode potential of the sheet being in the range of from −700 to −630 mV in a 0.1% sodium chloride solution at 25° C., against an AgCl reference electrode.

2. A method for producing an aluminum alloy sheet for container excellent in corrosion resistance, said method consisting essentially of the steps of:

hot rolling a cast ingot composed of an aluminum alloy consisting essentially of, in weight percentages:

Mg: from 0.50 to 2.0%
Si: from 0.10 to 0.70%
Mn: from 0.30 to 1.5%
Cu: from 0.52 to 1.0% and the balance being essentially aluminum;

then cold rolling said ingot to obtain an intermediate sheet with a thickness of at least one and a half times the thickness of said aluminum alloy sheet;

then heating said intermediate sheet to a temperature of 500° C. or higher and then rapidly cooling same from said heating temperature; and final cold rolling said intermediate sheet to obtain said aluminum alloy sheet.

3. A can comprising a can body and can ends, said can body being made of a steel sheet and said can ends being made of an aluminum alloy sheet consisting essentially of, in weight percentages:

Mg: from 0.50 to 2.0%
Si: from 0.10 to 0.70%
Mn: from 0.30 to 1.5%
Cu: from 0.52 to 1.0% and the balance being essentially aluminum, the spontaneous electrode potential of said aluminum alloy sheet being in the range of from −700 to −630 mV in a 0.1% sodium chloride solution at 25° C., against an AgCl reference electrode, the difference of the spontaneous electrode potentials of said aluminum alloy sheet and said steel sheet being in the range of −30 mV to +30 mV.

* * * * *

UNITED STATES PATENT AND TRADEMARK OFFICE

CERTIFICATE OF CORRECTION

PATENT NO. : 4 707 195

DATED : November 17, 1987

INVENTOR(S) : Shin TSUCHIDA et al

It is certified that error appears in the above-identified patent and that said Letters Patent is hereby corrected as shown below:

Column 8, line 20; change "final" to ---then---.

Signed and Sealed this

Third Day of May, 1988

*Attest:*

*Attesting Officer*

DONALD J. QUIGG

*Commissioner of Patents and Trademarks*